US007744113B2

(12) United States Patent
Farges

(10) Patent No.: US 7,744,113 B2
(45) Date of Patent: Jun. 29, 2010

(54) RESTRAINING AND LONGITUDINAL POSITION ADJUSTING DEVICE OF A BINDING FOR SKIS

(75) Inventor: Frédéric Farges, Moirans (FR)

(73) Assignee: Skis Rossignol, Moirans (FR)

( * ) Notice: Subject to any disclaimer, the term of this patent is extended or adjusted under 35 U.S.C. 154(b) by 140 days.

(21) Appl. No.: 11/904,406

(22) Filed: Sep. 27, 2007

(65) Prior Publication Data

US 2008/0088114 A1 Apr. 17, 2008

(30) Foreign Application Priority Data

Sep. 27, 2006 (FR) ..... 06 08476
Aug. 29, 2007 (FR) ..... 07 06057

(51) Int. Cl.
*A63C 9/08* (2006.01)

(52) U.S. Cl. ..... 280/618; 280/11.31

(58) Field of Classification Search ..... 280/11.14, 280/11.31, 607, 611, 613, 616, 617, 618, 280/634

See application file for complete search history.

(56) References Cited

U.S. PATENT DOCUMENTS 3,897,076 A * 7/1975 Beyl ..... 280/634
5,116,073 A * 5/1992 Goud ..... 280/617
6,786,501 B2 * 9/2004 Derisoud et al. ..... 280/623
7,393,002 B2 * 7/2008 Thomas et al. ..... 280/613
7,431,310 B2 * 10/2008 Redor et al. ..... 280/11.14
7,448,641 B2 * 11/2008 Buquet et al. ..... 280/607
2004/0094917 A1 * 5/2004 Frigo et al. ..... 280/11.31

* cited by examiner

*Primary Examiner*—Lesley Morris
*Assistant Examiner*—John D. Walters
(74) *Attorney, Agent, or Firm*—Fay Sharpe LLP

(57) ABSTRACT

A device for retaining and longitudinally adjusting a binding (4, 6) on a ski (2) is attached in a removable and adjustable fashion on the upper surface of said ski in a determined longitudinal position. The binding includes a base plate (9) longitudinally slidably mounted on the support piece (8) interdependent with the ski. The base plate carries a lock which is vertically movable for permitting displacement towards the top and towards the bottom, and inversely. A biasing system urges the lock from its unlocked position (upper position), towards its unlocked position (lower position) such that it cooperates with the support piece. A structure maintains a transverse position of the removable unlocking tool (15), which is configured to retain the lock in the upper, unlocked position.

11 Claims, 6 Drawing Sheets

RESTRAINING AND LONGITUDINAL POSITION ADJUSTING DEVICE OF A BINDING FOR SKIS

BACKGROUND

The present invention concerns a device for retaining and adjusting the longitudinal position of a binding on a board for sliding on snow such as a ski or the like.

In an already known manner, the boot of a skier, on the body of a ski of the alpine type, is retained on the ski in a removable fashion, by its front end, by a front safety binding commonly called "butee" and, by its rear end, and in particular its heel, thanks to a rear safety binding commonly called "talonniere."

It is known that, for good control of the skis, the boot must, in the retained position on the ski, be in a predetermined and precise longitudinal position on the ski, for permitting a correct performance of the ski. Also, the manufacturers affix at the time of fabrication of the skis make a mark, that must correspond to the middle of the sole of the boot, when it is retained on the ski. Analogously, the manufacturers of ski boots indicate by a mark the middle of the boot. When mounting the ski bindings, the front and rear bindings have to be attached on the ski in the predetermined longitudinal positions, such that the middle of the boot corresponds to the mark made on the ski.

The manufacturers have developed a means of adjustment, intended particularly for moving of the location, permitting attending to adjusting the position of the binding(s), easily, and without the necessity of specialized tools. These devices are often such that the maneuvering means permits the adjustment, whether placed in the front end of the body of the binding, to be easily accessible by the operator. All the time this kind of device presents a certain number of inconveniences, and particularly those of being in a position that permits an inopportune unlocking, like for example in response to a shock by the ski, or another object.

SUMMARY

The present invention resolves the inconveniences of the adjusting devices known today in proposing a device particularly simple and reliable, that permits the very easy detachment of the ski binding and stocking independently of the ski. The tool needed for adjustment being removable and being only a simple stem. This is particularly interesting for changing of the location.

Also, the device for retaining and adjusting the longitudinal position of a binding on a ski permitting mounting in a removable and adjustable fashion on the upper surface, and it, in a longitudinally determined position, the aforementioned mounting comprehending a sliding base plate longitudinally mounted on a support piece interdependent with the ski, the aforementioned base plate comprehending a lock is moveable in vertical displacement for permitting upward and downward displacement, and conversely, such that it is urged by a biasing system, from the unlocked position (upper position), towards the locked position (lower position) such that it cooperates with the support piece and is according to the invention, characterized in that the device includes means for maintaining in transverse position of a removeable unlocking tool configured to retain the lock in the lock in the upper unlocked position.

According to complimentary characteristic, the unlocking tool includes a stem configured to be engaged in a transverse hole defined in the movable lock, in which one of its ends includes a handle part and that its other end advantageously includes a point.

According to another characteristic, the longitudinal locking position of the base plate of the binding on the support piece is made by cooperation of a tooth defined on the movable lock with a corresponding tooth on the support piece.

Note that the central part of the support piece constituting a slide track for the binding includes a central longitudinal cutout, which includes a vertical tooth configured to cooperate with a corresponding tooth of a movable lock mounted on the base plate of the corresponding binding.

Let us add that the lock includes a retaining projection extending upwards including the transverse locking hole configured to receive the transverse stem of the locking tool, such that the base plate of the binding includes at least one support zone on which the stem of the removable tool is supported in the lock such that the binding is unlocked from the support piece.

Note also that in the locked position on the support piece, in which the movable lock urged by it springs is in a lower position in which its teeth are engaged in the corresponding teeth of the support piece, the transverse locking hole of the lock is in part obscured by the support zones and in part not obscured permitting the introduction of the stem of the tool thanks to its pointed end, in other words, the lower part of the transverse locking hole is situated below the horizontal plane of the support zones, such that the upper part of the transverse locking hole is situated above the horizontal plane of the support zones, in order to leave free a passage permitting the introduction of the tool.

The support piece is a piece which extends longitudinally for constituting a slide track for the mounting base, the lower part of which is of complimentary form.

The other characteristics and advantages of the invention will become apparent from the following description in conjunction with the attached drawings which are given by way of non-limiting examples.

BRIEF DESCRIPTION OF THE DRAWINGS

FIG. 5 is a partial longitudinal sectional view.

FIG. 6 is a transverse sectional view through the lock.

FIG. 7 is a view in partial longitudinal section.

FIG. 8 is a view in transverse section through the lock.

DETAILED DESCRIPTION

The invention will be described by way of example, in the case where a boot is retained on the ski by its ends.

Figure 1:
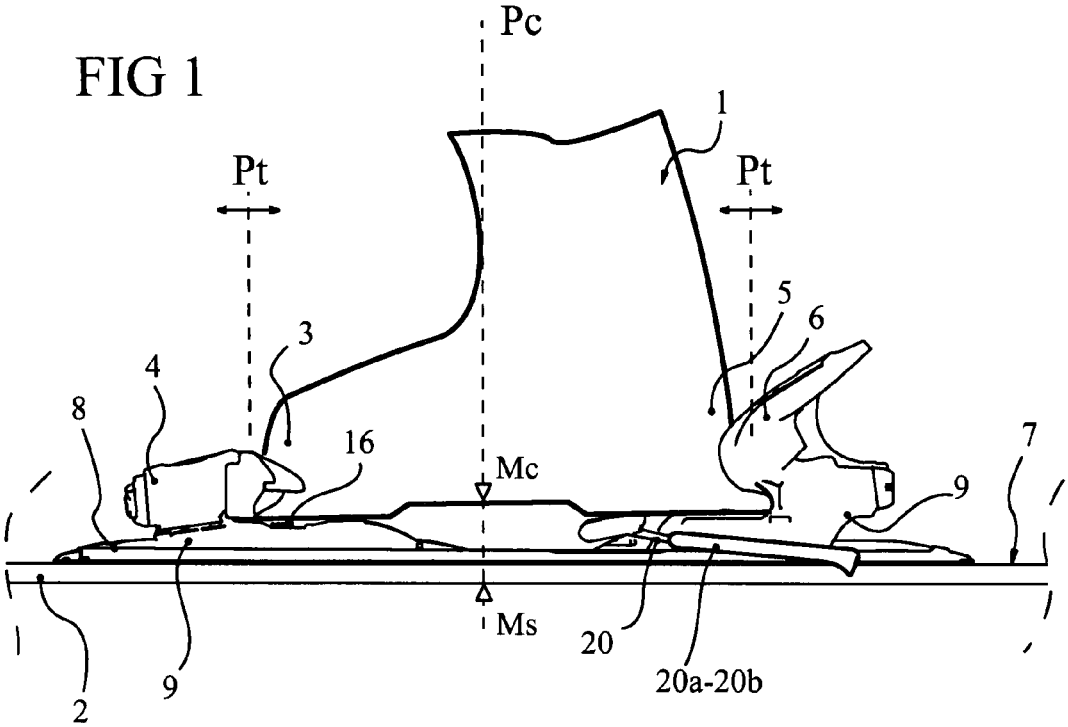
FIG. 1 is a side view of a ski equipped with front and rear bindings for the boot, including the inventive device, the boot being in a retained position for skiing.

As is apparent in FIG. 1, the boot 1 of the skier is retained on the ski 2 in a releasable fashion, by its front end 3, by a front safety binding 4 commonly called a "butee" and, by its rear end, and particularly by its heel 5, by means of a rear safety binding commonly called a "talonniere."

The boot 1 must, in a retained position on the ski, be in a fixed longitudinal position Pc on the ski. This position must be such that the middle of the sole Mc corresponds to a mark Ms typically made on the ski 2 by the manufacturer.

The invention concerns the device permitting the attaching one or the other of the front 4 and/or the rear 6 bindings on the upper surface 7 of the ski 2, in a selected fixed longitudinal position Pb, Pt adapted to the length of the sole of the boot 1, in a known manner, in a selected longitudinal position Pb for the butee 4 and in a selected longitudinal position Pt for the talonniere 6, the positioning of the boot between the two bindings 4, 6 permitting the alignment of the two marks Mc and Ms, such as is illustrated in FIG. 1.

Also, one or the other, and even each of the bindings 4, 6, includes the retaining device of the invention, which includes means for setting the longitudinal position on the ski and for retaining in the appropriate chosen position.

The device of the invention is made up of by a support piece 8 fixed to the upper surface 7 of the ski 2 intended to retain one or both bindings 4, 6 in a fixed position. In other words, the binding 4, 6 is mounted slidably on the support piece for being retained there after positional adjustment, in a fixed longitudinal position.

To this effect, the binding 4, 6 cooperates with the support piece by way of a slide and slide track system, such that the said binding includes a movable lock intended to cooperate with the realized complimentary means defined on the support piece.

Also, the support piece 8 includes in a known fashion, a slide on which the binding and for example the base plate 9 is intended to slide, whose lower part is complimentarily formed. Of course, the support piece 8 extends longitudinally and can be an independent piece fixed on the ski or an integral part of the ski.

Note too that the central part of the support piece 8 includes the slide track for the binding 4, 6 including a central longitudinal cutout 10 which includes a set of vertical teeth 11*a*, 11*b* configured to cooperate with a corresponding set of teeth 13*a*, 13*b* of a movable lock 12 mounted on the base plate 9 of the corresponding binding.

Said movable lock 12 is movable in vertical displacement on the base plate 9 for enabling displacement towards the top and towards the bottom, and inversely. Also the movable lock 12 is urged by a biasing system 14*a*, 14*b* from the unlocked position (towards the top), towards the locked position (towards the bottom) such that its corresponding set of teeth 13*a*, 13*b* cooperate with the set of teeth 11*a*, 11*b* of the slide track 8.

According to this embodiment illustrated by way of example, each of the two side edges relative to the central longitudinal cutout 10, includes a set of teeth 11*a*, 11*b*, such that the movable lock 12 also includes two side sets of teeth 13*a*, 13*b*.

The movable lock 12 is configured to lock the base plate 9, of the binding, in a given longitudinal position relative to the support piece 8, by the cooperation of the sets of teeth 13*a*, 13*b* with the sets of teeth 11*a*, 11*b* of the central longitudinal cutout 10 of the support piece 8.

Also, the movable lock 12 is moveably mounted for vertical displacement towards the top HA and towards the bottom BA and inversely, on the base plate 9 and is urged towards the bottom in the locked position by a biasing system 14 such as the springs 14*a*, 14*b*, in one position in which the sets of teeth 13*a*, 13*b* are in cooperation with the sets of teeth 11*a*, 11*b* of the support piece 8.

The maintenance of the lock 12 in the upper unlocked position in which the sets of teeth 13*a*, 13*b* are not engaged with the sets of teeth 11*a*, 11*b* of the support piece, is achieved by means of a removable locking tool 15.

One will note that the locking tool 15 includes a locking stem 15*a* including advantageously at one of its end a handle part 15*b* whereas its other end includes advantageously a point 15*c* whose function will be explained.

According to the invention, the device for retaining and adjusting a longitudinal position of the binding 4 and/or 6 on a ski 2 permits the attachment in a removable and adjustable fashion on the upper surface 7 of said ski 2, includes means for holding for the removable locking tool 15 configured to retain the lock in the unlocked binding position.

The lock 12 includes a retaining projection 12*a* which extends upward including a transverse locking hole 12*b* intended to receive the transverse stem 15*a* of the locking tool 15.

Note also that the base plate 9 of the binding includes at least one support zone 9*a*, 9*b* on which a stem of the tool is supported in the position of locking activation of the unlocked position of the lock.

Figure 7:
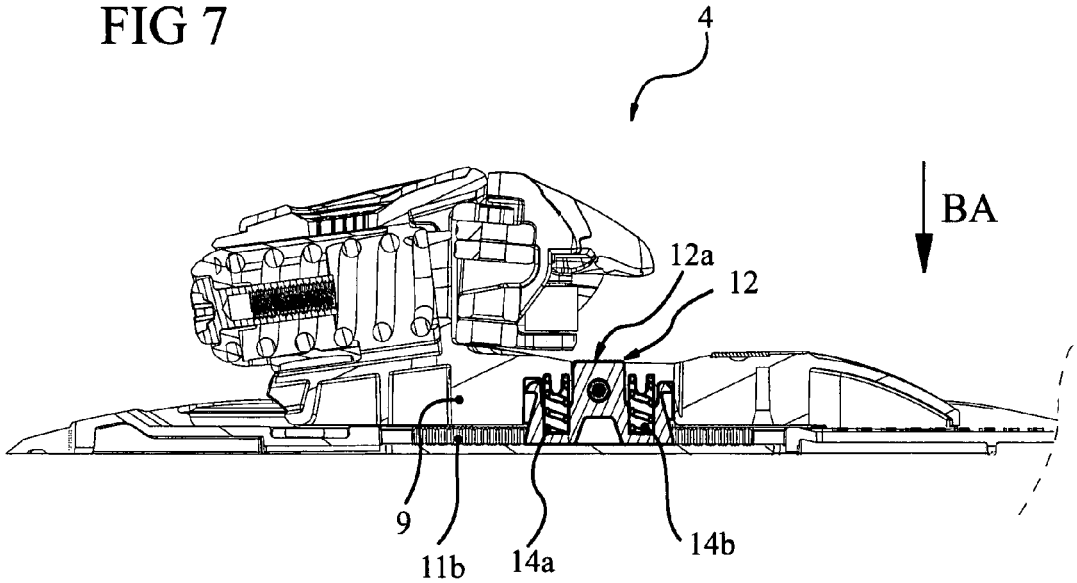
FIGS. 7 and 8 illustrate the binding in a position in which the lock is in the lower position for locking the adjusted position of the binding.
Figure 8:
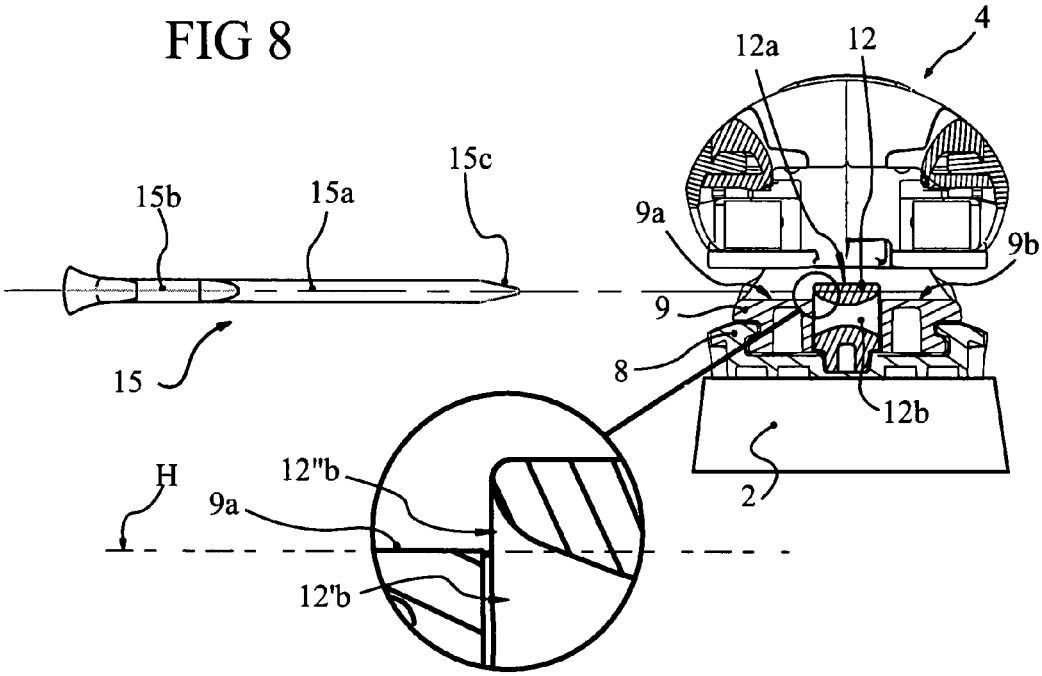
Figure 9:
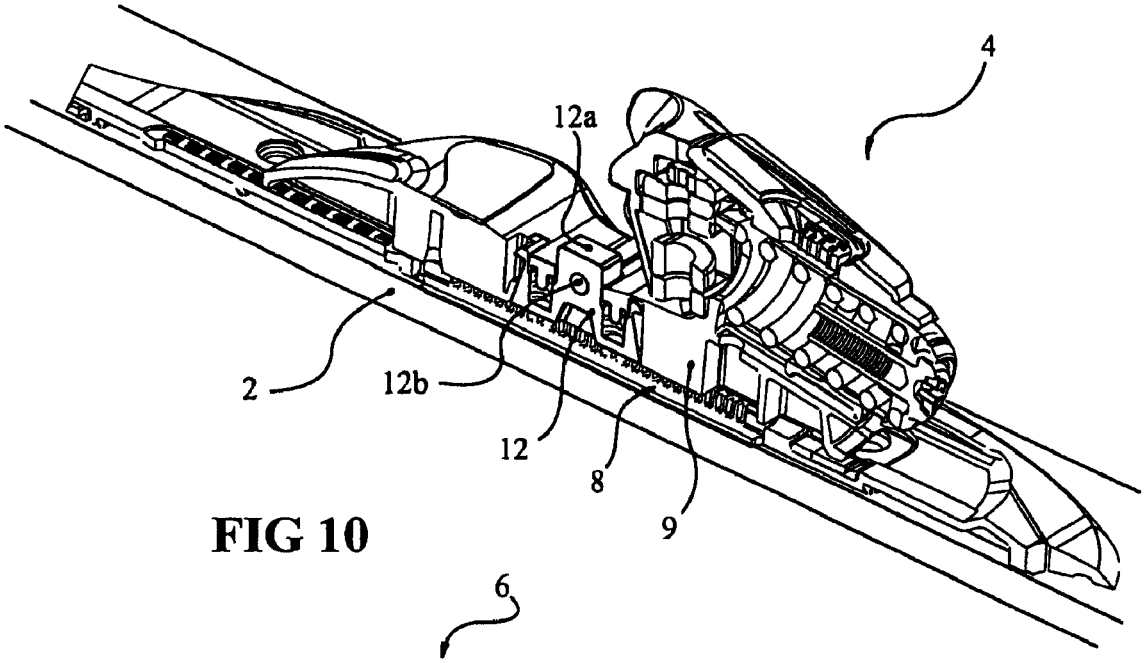
FIG. 9 is a perspective view showing the front binding with a partial cutaway made through the lock.

FIGS. 7 and 8 represent a binding 4, 6 in a locked position on the support piece 8. In this position, the movable lock urged by the springs is in a lower position in which its teeth 13*a*, 13*b* are engaged in the corresponding teeth 11*a*, 11*b* of the support piece 8. In this position, one will note that the transverse locking hole 12*b* of the lock is in part hidden 12'*b* by the support zones 9*a*, 9*b* and in part not hidden 12"*b* permitting the introduction of the transverse stem 15*a* of the tool 15 by virtue of the pointed end 15*c*. In other words, the lower part 15'*b* of the transverse locking hole 12*b* of the lock is situated beneath the horizontal plane H of the support zones 9*a*, 9*b* such that the upper part 12"*b* of the transverse locking hole 12*b* of the lock is situated above the horizontal plane H of the support zones 9*a*, 9*b* and in order to leave free a passage 12"*b* permitting the introduction of the tool 15.

Figure 5:
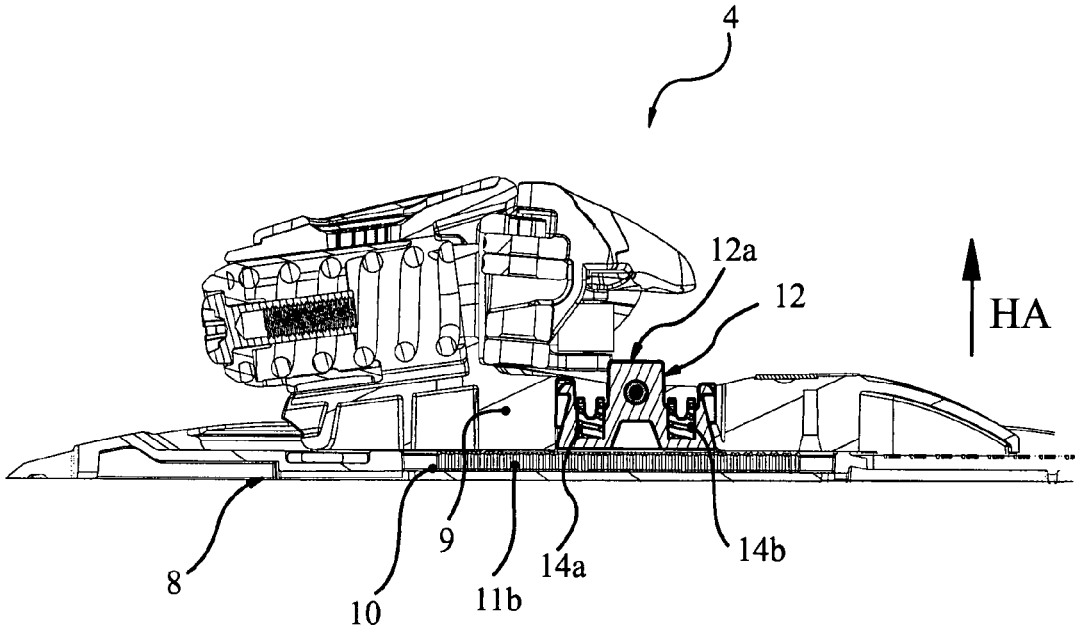
FIGS. 5 and 6 illustrate the binding in a position such that the lock is in the upper locked position by the locking tool.
Figure 6:
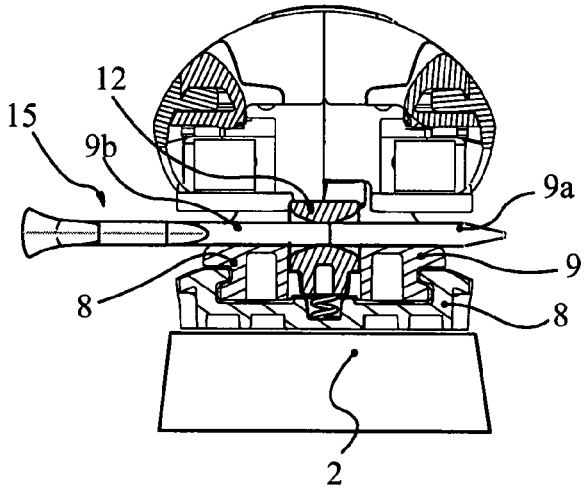

FIGS. 5 and 6 represent the binding 4, 6 in the unlocked position relative to the support piece 8, that is to say in the position according to which, there is not any cooperation between the teeth 13*a*, l3*b* of the lock and the corresponding teeth 11*a*, 11*b* of the support slide 8. This position is maintained thanks to a locking tool 15 whose stem 15*a* is engaged in the transverse hole 12 which transversely traverses the projection 12*a* of the lock. One will note that in this position, the stem 15*a* of the tool is supported on the side support zones 9*a*, 9*b*.

According to a preferred embodiment of the invention, the device includes means for maintaining the transverse position of the locking tool 15. This means is made up in part by the transverse hole 12*b* defined in the projection of the lock 12 but also in part by a transverse throat 16 defined on the base plate 9 indeed the transverse hole 16', the transverse throat 16 and the transverse hole 16" constituting also the side support zones 9*a*, 9*b*, for the stem of the locking tool of the lock.

One understands that thanks to the device of the invention, one or more bindings can be easily adjusted in longitudinal position, and can be withdrawn very easily on the support slide, in order to be for example stocked independently of the ski in a position according to which the lock is retracted, permitting replacement of the binding on the slide.

In the case of a front binding called a "butee" one understands that the projection 12*a* of the lock precisely fits the projection in front of the jaw 4*a*, preventing also the putting in place of the boot 1 in position on the binding not locked on the ski.

Figure 2:
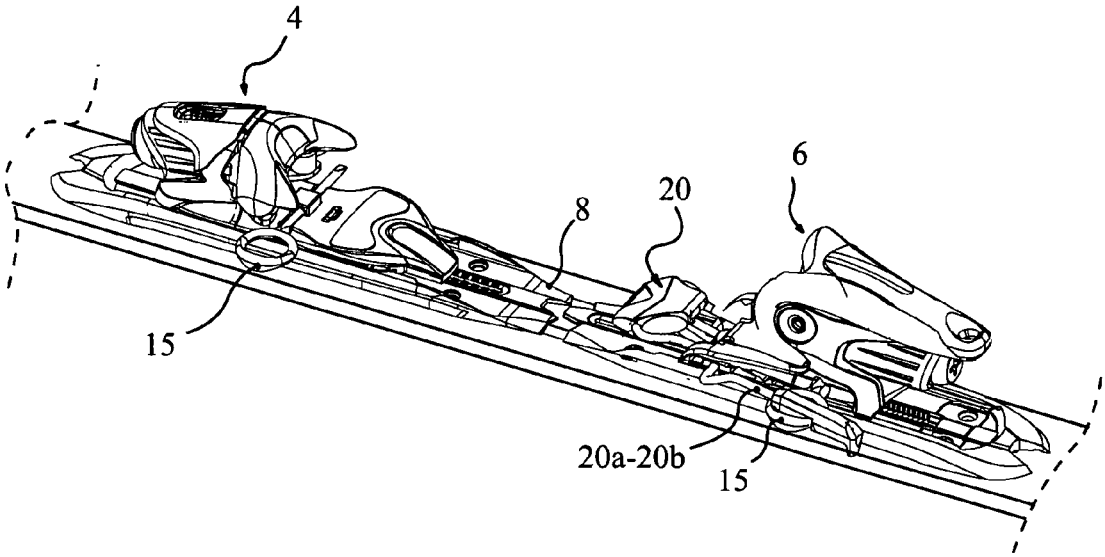
FIG. 2 is a perspective assembly view of a ski equipped with two bindings according to the invention.
Figure 3:
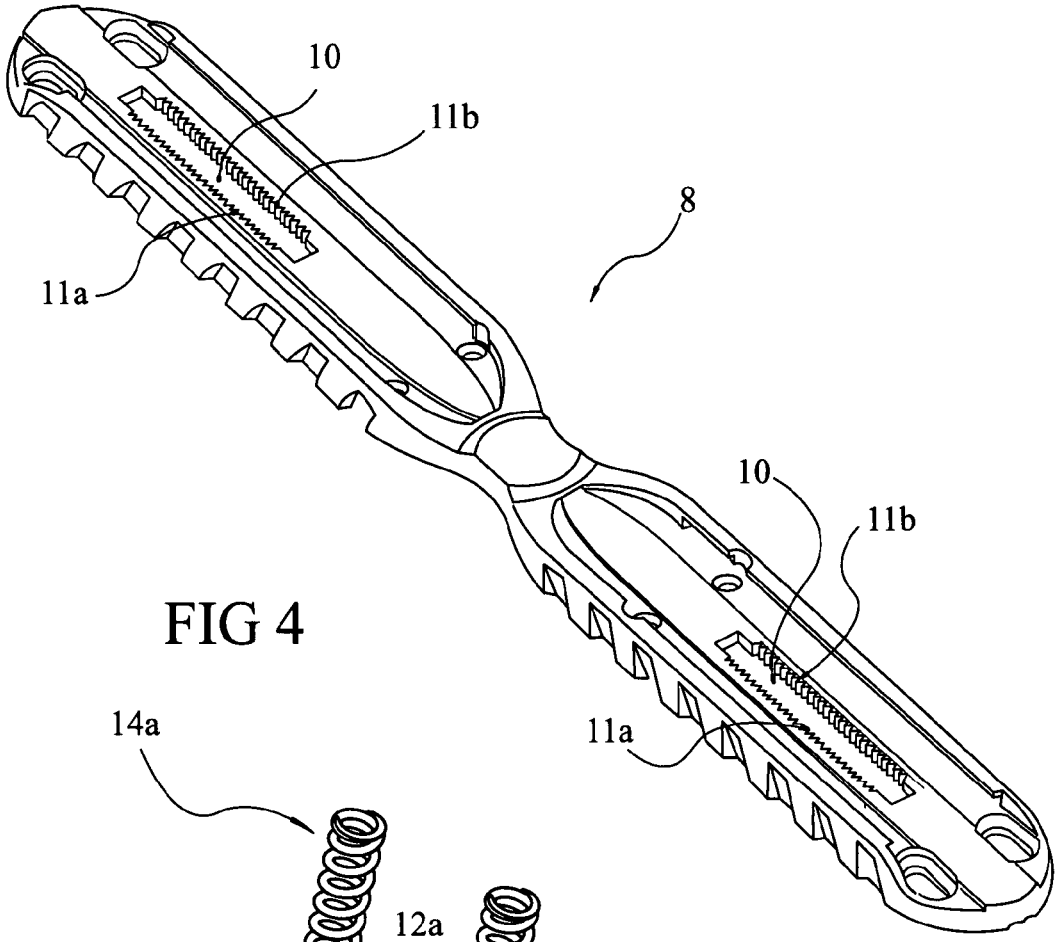
FIG. 3 is a perspective from above representing the support piece serving as a slide.
Figure 4:
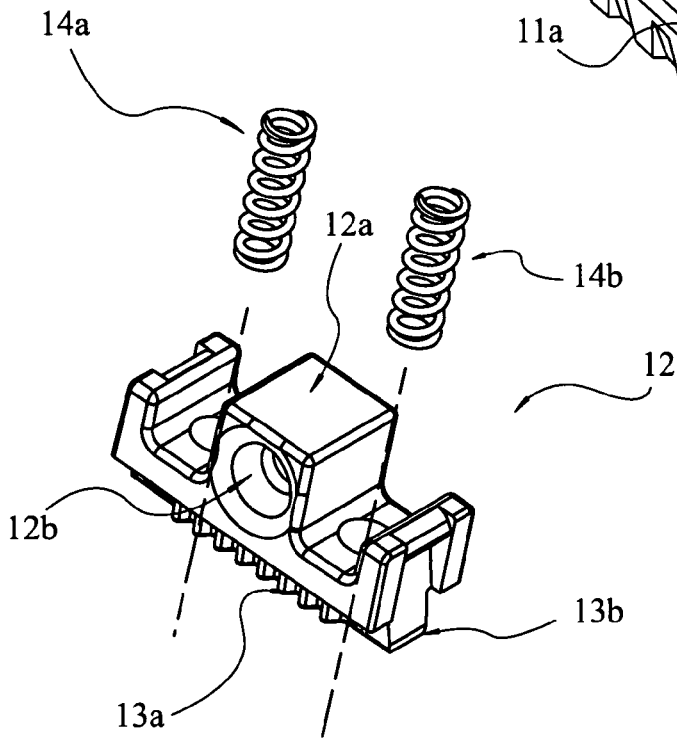
FIG. 4 is a perspective view showing the lock with its biasing system, particularly its springs.
Figure 10:
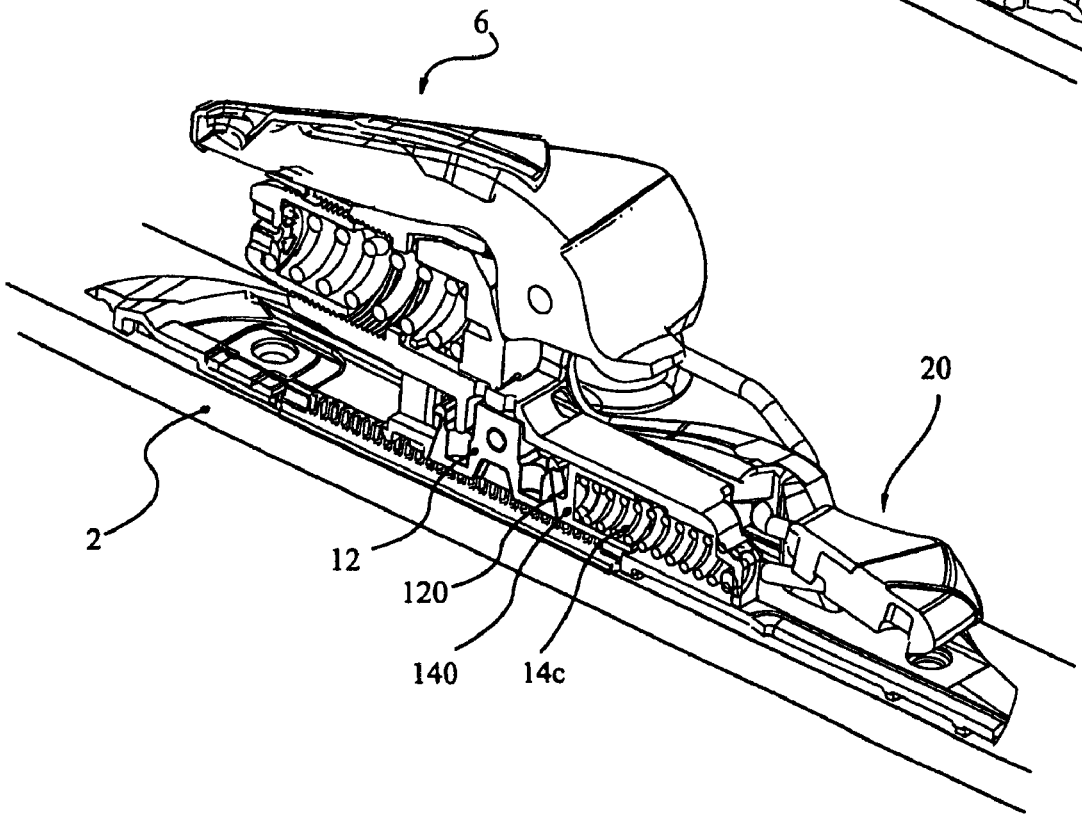
FIG. 10 is a perspective view showing the rear binding with a partial cutaway made through the lock.
Figure 11:
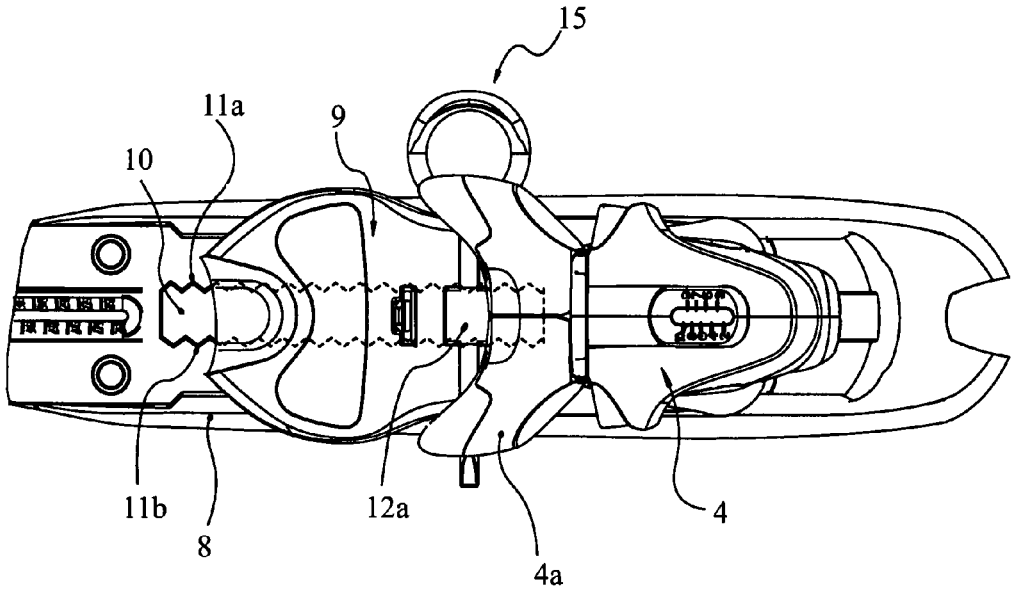
FIG. 11 is a view from above showing the front binding with the locking tool.
Figure 12:
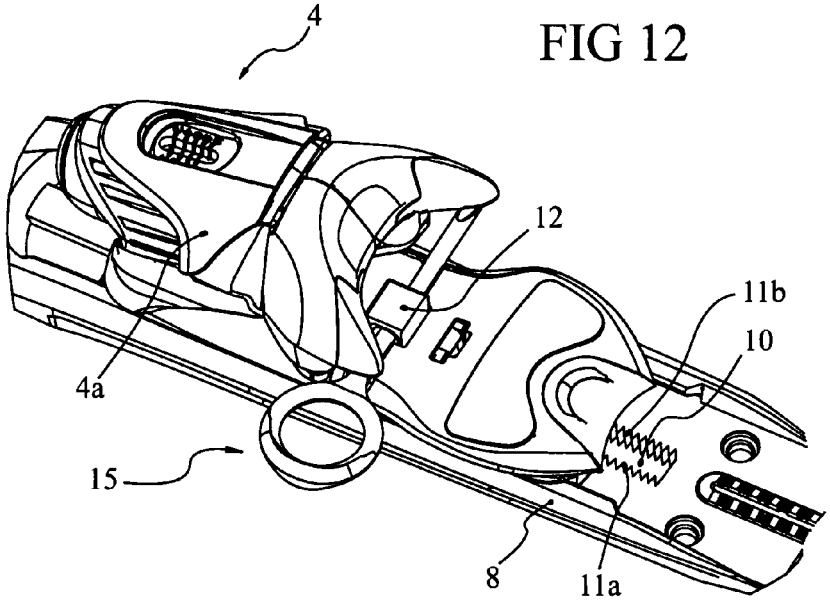
FIG. 12 is a perspective view showing the front binding with the locking tool.

In the case of the rear binding called the talonniere 6 illustrated in FIGS. 1, 2, 10, one will note that the locking tool for the lock, and particularly the transverse stem 15*a* is useful not only to retain the lock 12 in the upper position, but to hold the brake 20 in a retracted position such as illustrated by the brake arms 20*a*, 20*b*. Note also that for the talonniere 6, the lock 12 is urged downwards by the release spring 14*c*, thanks to the cooperation of a piston 140 with a ramp 120.

Of course, the invention is not limited to the embodiments described and shown by the examples, but includes also all the equivalents as well as their combinations.

Also and for example, the cooperation between the lock 12 and the support piece 8, such as illustrated that is made by cooperation with the vertical teeth could and without departing from the framework of the invention be realized by horizontal teeth and even by one or a plurality of vertical rods engaged in holes.

Note also that the device of the invention can be utilized for positioning an adjustment plate in a position on which will be mounted the front butee and the talonniere and this in order indeed to displace the position of the middle of the boot.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A device for retaining and adjusting the longitudinal position of a binding on a ski permitting mounting in a removable and adjustable fashion on the upper surface of said ski in a selected fixed longitudinal position, the binding including:

a base plate longitudinally slidably mounted on a support piece interdependent with the ski, the base plate including:

a lock vertically movable upward and downward, and inversely, a biasing system urges the lock from an upper unlocked position towards a lower locked position in which the lock cooperates with the support piece, a means for maintaining a transverse position of a removable unlocking tool, which unlocking tool is configured to retain the lock in the upper unlocked position; and wherein the unlocking tool includes:

a straight stem configured to be engaged in a transverse hole defined in the lock.

2. The device according to claim 1, wherein the locking tool includes at one of its ends a handle part and at its other end a point.

3. The device according to claim 1, wherein in the longitudinal position of the base plate of the binding on the support piece is locked by cooperation of at least a tooth defined on the lock with a corresponding at least one tooth of the support piece.

4. The device according to claim 3, wherein a central part of the support piece includes:

a slide track for sliding movement of the binding, a central longitudinal cutout which has a vertical tooth configured to cooperate with a corresponding tooth of the lock when the lock is mounted on the base plate of the corresponding binding.

5. The device according to claim 1, wherein the support piece extends longitudinally for defining a slide track for the base plate of the binding, a lower part of the binding being of complimentary form to the slide track.

6. The device according to claim 1, wherein the transverse hole in the lock is configured such that the stem is inserted longitudinally into the lock.

7. The device according to claim 6, wherein the stem is rounded in cross-section and has a tapered point at an end that is inserted into the transverse hole, the tapered point cams the lock against the biasing system moving the lock out of engagement with the support piece and with continued insertion, the stem holds the lock out of locking engagement permitting the base plate to be slidably positioned relative to the support piece.

8. A device for retaining and adjusting the longitudinal position of a binding on a ski permitting mounting in a removable and adjustable fashion on the upper surface of said ski in a selected fixed longitudinal position, the binding including:

a base plate longitudinally slidably mounted on a support piece interdependent with the ski;

a lock vertically movable upward and downward, and inversely;

a biasing system urges the lock from an upper unlocked position towards a lower locked position in which the lock cooperates with the support piece; and the lock including a retaining projection extending upward which retaining projection defines a transverse hole configured to receive and maintain a transverse position of a transverse stem of a removable unlocking tool to retain the lock in the upper unlocked position.

9. The device according to claim 8 wherein the base plate of the binding includes:

at least one support zone on which the stem of the unlocking tool is supported to maintain the lock unlocked from the support piece.

10. The device according to claim 9, wherein in the locked position on the support piece lock is urged by its spring into a lower position such that its teeth are engaged in corresponding teeth of the support piece, the transverse locking hole of the lock being partially obscured by the support zones and partially not obscured permitting an introduction of the stem of the unlocking tool by way of its pointed end, such that a lower part of the transverse locking hole of the lock is situated below a horizontal plane of the support zone and an upper part of the transverse locking hole of the lock is situated above the horizontal plane of the support zone in order to leave free a passage permitting the introduction of the tool.

11. A device comprising:

a support piece configured to be mounted to a ski, the support piece defining a slide track and a plurality of teeth;

a base plate to which a binding is mountable, the base plate being configured to slide in the support piece slide track;

a lock element defining a plurality of teeth, the locking element being movably mounted in the base plate for movement between a locking position in which the teeth of the lock engage the teeth of the support piece and an unlocked position in which the teeth of the lock are displaced from the teeth of the support piece, a biasing assembly which biases the lock element toward the locking position; and an unlocking key which is configured to move the lock element to the unlocked position and retain the locking element in the unlocked position, the unlocking key including:

a handle portion, a straight elongated stem extending from the handle portion, and the elongated portion defining a tapered point at an end opposite the handle portion such that the tapered point cams the lock against the biasing assembly moving the lock teeth out of engagement with the support piece teeth in response to longitudinal force and with continued insertion, the stem holds the teeth out of engagement without a user continuing to apply force to the unlocking key permitting the base plate to be slidably positioned relative to the support piece;

wherein the lock element defines a hole and the base plate defines a key receiving surface, the key receiving surface and the hole being partially aligned in the locked position such that as the tapered point passes over the key receiving surface and engages the hole and the point cams the lock against the baising assembly.

* * * * *